US008256360B2

(12) United States Patent
Chow

(10) Patent No.: US 8,256,360 B2
(45) Date of Patent: Sep. 4, 2012

(54) MASSAGE TABLE WITH SECURE LOCK LEGS

(75) Inventor: William W. Chow, Del Mar, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 842 days.

(21) Appl. No.: 11/436,735

(22) Filed: May 18, 2006

(65) Prior Publication Data

US 2006/0260516 A1 Nov. 23, 2006

Related U.S. Application Data

(60) Provisional application No. 60/683,361, filed on May 20, 2005.

(51) Int. Cl.
*A47B 3/083* (2006.01)

(52) U.S. Cl. ..... 108/169; 108/35

(58) Field of Classification Search ..... 248/188.5; 108/35, 38, 166, 167, 169, 170, 171, 172, 108/173, 174

See application file for complete search history.

(56) References Cited

U.S. PATENT DOCUMENTS 3,855,946 A * 12/1974 Bales ..... 108/147.21
3,947,140 A * 3/1976 Thomas ..... 403/108
4,333,638 A 6/1982 Gillotti
4,833,998 A 5/1989 Everett et al.
4,943,041 A * 7/1990 Romein ..... 5/620
5,009,170 A 4/1991 Spehar
5,394,809 A 3/1995 Feldpausch et al.
D360,692 S 7/1995 Gambino
5,524,555 A 6/1996 Fanuzzi
5,676,062 A 10/1997 Lloyd
5,746,152 A * 5/1998 Huse ..... 114/363

(Continued)

OTHER PUBLICATIONS http://www.ecybex.com/Products/displayproductnoflash.aspx?id=5411 CYBEX web site, 45 Degree Back Extension (Product # 5411). The position adjustment for the hip support includes a locking pin that fits into a hole in the support beam and a diagonal locking bolt that urges against the support beam. The Applicants admit that this product is prior art, Mar. 30, 2006.

(Continued)

*Primary Examiner* — Jose V Chen
*Assistant Examiner* — Matthew Ing
(74) *Attorney, Agent, or Firm* — Roeder & Broder LLP

(57) ABSTRACT

A massage table for supporting a person above a surface during a massage includes a table top assembly and a leg assembly. The table top assembly supports the person. The leg assembly is secured to the table top assembly and supports the table top assembly above the surface. The leg assembly includes a plurality of legs. At least at least one of the legs includes (i) a first leg section that is attached to the table top assembly, (ii) a second leg section that is movable relative to the first leg section to adjust the position of the table top assembly relative to the support, and (iii) a section attacher that selectively attaches the first leg section to the second leg section. In one embodiment, the section attacher includes a section stop and a section clamp. The section stop inhibits relative movement between the first leg section and the second leg section. The section clamp also selectively inhibits relative movement between the first leg section and the second leg section. With this design, in certain embodiments, the leg is designed to inhibit relative movement between the leg sections to insure quiet use of the massage table.

18 Claims, 5 Drawing Sheets

U.S. PATENT DOCUMENTS 5,779,386 A * 7/1998 Eichhorn ..... 403/329
5,913,271 A 6/1999 Lloyd
5,943,965 A 8/1999 Riach et al.
6,000,345 A 12/1999 Gillotti
6,076,472 A 6/2000 Lloyd
6,182,578 B1 2/2001 Fanuzzi
6,192,809 B1 2/2001 Riach et al.
6,431,086 B1 8/2002 Lloyd
6,550,405 B2 4/2003 Gosselin
6,684,426 B1 2/2004 Lin et al.
6,705,234 B1 3/2004 Miller et al.

OTHER PUBLICATIONS

Search Report and Written Opinion for PCT/US06/19613 (related to the present application), Aug. 27, 2007, Earthlite Massage Tables, Inc.

* cited by examiner

MASSAGE TABLE WITH SECURE LOCK LEGS

RELATED APPLICATION

This application claims priority on pending Provisional Application Ser. No. 60/683,361 filed on May 20, 2005 and entitled "Massage Table with No-Shake Legs". As far as is permitted, the contents of Provisional Application Ser. No. 60/683,361 are incorporated herein by reference.

BACKGROUND

As the benefits of therapeutic massage are becoming more widely appreciated, more and more people are participating in therapeutic massage. A typical massage table allows the patient to be resting while receiving a massage. Important features for massage tables include high strength in the lateral and vertical directions, light weight, quiet operation, stability, rigidity, ease and speed of set-up, adjustment and folding, and portability.

SUMMARY

A massage table for supporting a person above a surface during a massage includes a table top assembly and a leg assembly. The table top assembly supports the person. The leg assembly is secured to the table top assembly and supports the table top assembly above the surface. The leg assembly includes a plurality of legs. At least at least one of the legs includes (i) a first leg section that is attached to the table top assembly, (ii) a second leg section that is movable relative to the first leg section to adjust the position of the table top assembly relative to the surface, and (iii) a section attacher that selectively attaches the first leg section to the second leg section. In one embodiment, the section attacher includes a section stop and a section clamp. The section stop inhibits relative movement between the first leg section and the second leg section. The section clamp also selectively inhibits relative movement between the first leg section and the second leg section. With this design, in certain embodiments, the leg is designed to inhibit relative movement between the leg sections to ensure quiet use of the massage table. Further, in certain embodiments, this feature allows for the use of larger clearances between the leg sections. This can reduce manufacturing costs and increase ease of use.

In one embodiment, the first leg section includes a first aperture and the section stop includes a button that is designed to fit through the first aperture. Additionally, the first leg section can include a second aperture and the section clamp can include a threaded stud that fits through the second aperture. Further, the section clamp includes an internally threaded surface that is secured to the second leg section, and the threaded stud is threaded into the internally threaded surface.

In one embodiment, the distance between the internally threaded surface and the button along a first axis is approximately equal to the distance between the first aperture and the second aperture along the first axis.

In another embodiment, the button includes an internally threaded surface and wherein the section clamp includes a threaded stud that is threaded into the internally threaded surface of the button.

In yet another embodiment, the section clamp includes a threaded stud that can be threaded into an internally threaded surface that is coupled to the second leg section.

In some embodiments, the section clamp deforms a portion of at least one of the leg sections to inhibit substantially all relative movement between the first leg section and the second leg section.

For certain designs, the leg assembly includes four spaced apart legs and each of the four legs includes a first leg section, a second leg section, and a section attacher that selectively attaches the first leg section to the second leg section. For each leg, the section attacher includes a section stop that selectively inhibits relative movement between the first leg section and the second leg section, and a section clamp that selectively inhibits relative movement between the first leg section and the second leg section.

The present invention is also directed to a method for making an adjustable-height massage table.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
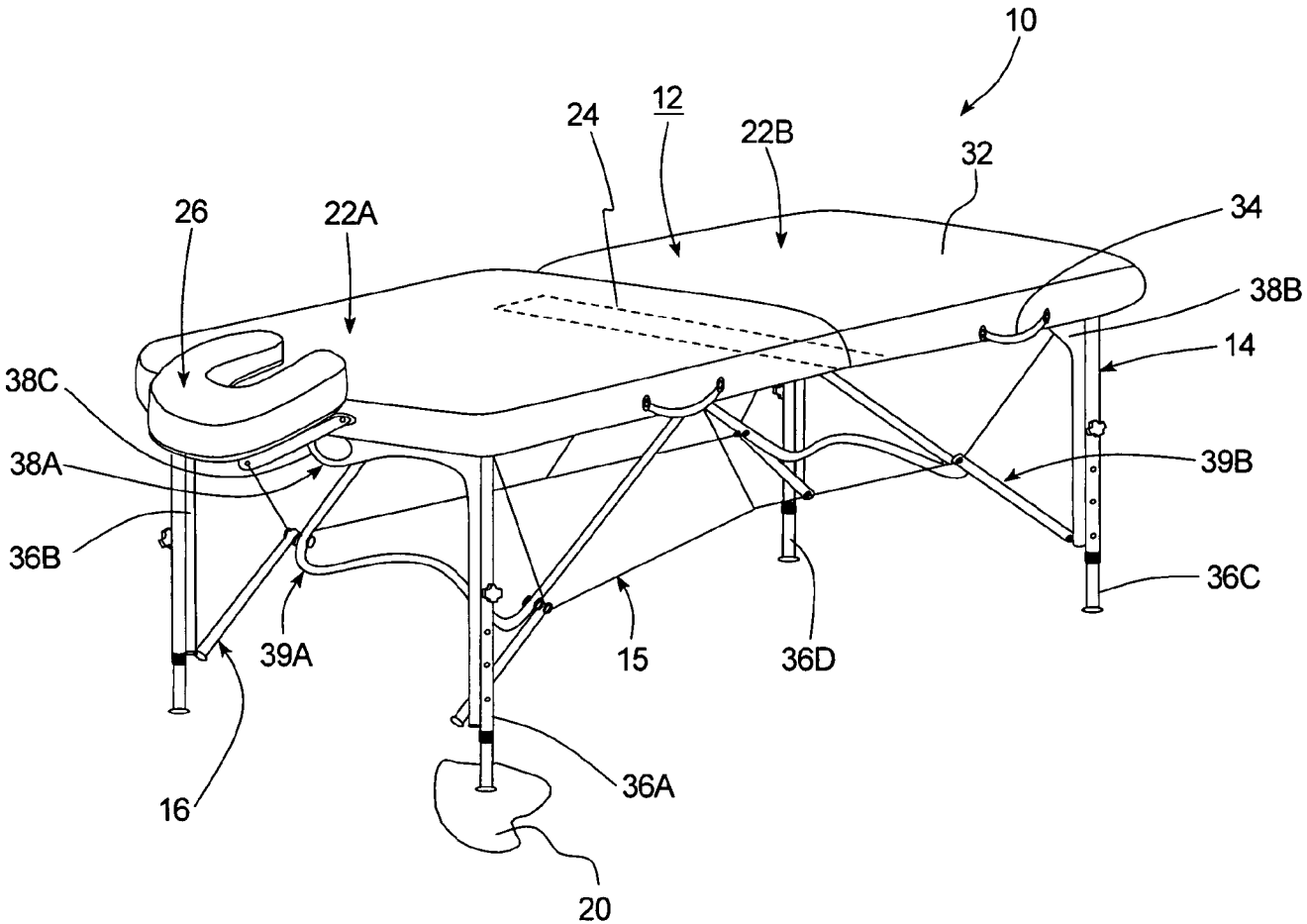
FIG. 1 is a simplified perspective view of a massage table having features of the present invention.

FIG. 1 is a simplified top perspective view of a massage table 10 having features of the present invention. In this embodiment, the massage table 10 includes a table top assembly 12, a leg assembly 14, a cable assembly 15 and a brace assembly 16. The design of these components can be varied to achieve the desired shape, weight, and strength characteristics of the massage table 10. Alternatively, the massage table 10 can be designed with fewer or more components than that illustrated in FIG. 1. For example, the massage table 10 could be designed without the cable assembly 15 or with a different type of cable assembly 15 than that illustrated in FIG. 1.

In certain embodiments, the massage table 10 is moveable between a working configuration (illustrated in FIG. 1) and a transport configuration (not shown). In the working configuration, the massage table 10 can be set up on a surface 20 (partly shown in FIG. 1), e.g. a floor, and the massage table 10 is ready for supporting a person above the surface 20 for a massage. In the transport configuration, the massage table 10 is folded and can be moved relatively easily.

As an overview, in certain embodiments, the leg assembly 14 is uniquely designed so that height of the massage table 10 is easy to adjust, the massage table has relatively strong, and the massage table is light weight. Further, in certain embodiments, the leg assembly 14 is uniquely designed to insure quiet use of the massage table 10.

The table top assembly 12 provides a surface for a person to rest on during a massage. In one embodiment, the table top assembly 12 includes a first table top 22A, an adjacent second table top 22B, a hinge assembly 24 (illustrated in phantom) and a headrest 26.

In FIG. 1, each table top 22A, 22B is generally rectangular shaped. Alternatively, for example, one or both table tops 22A, 22B can be another shape, such as an oval shape, an oblong shape, or rectangular shape with one or more rounded corners.

In one embodiment, each table top 22A, 22B includes a frame 30 (partly illustrated in FIG. 2), a pad (not shown), and a covering 32. Alternatively, for example, one or both of the table tops 22A, 22B can be made without the pad or covering.

The frame 30 is generally rigid and can be made of a rigid material such wood, aluminum, plastic or other suitable materials.

The pad provides a cushion for the comfort of the person resting on the massage table. Non-exclusive examples of suitable materials for the pad include foam, memory foam, fleece pads, etc.

The covering 32 secures the pad to the frame 30 and provides a protective covering for the pad. Non-exclusive examples of suitable materials for the covering 32 include leather, plastic, and cloth.

In one embodiment, each of the table tops 22A, 22B includes a handle 34 that facilitates carrying of the massage table 10 when the massage table 10 is in the transport configuration.

The hinge assembly 24 connects the table tops 22A, 22B together and allows the table tops 22A, 22B to pivot relative to each other between (i) the working configuration in which the table tops 22A, 22B are substantially in the same plane, and (ii) the transport configuration in which the table tops 22A, 22B are in substantially parallel planes with the table tops 22A, 22B being side by side. In one embodiment, the hinge assembly 24 is a piano hinge that is attached each of the table tops 22A, 22B. Alternatively, the hinge assembly 24 can have another design.

The headrest 26 provides a place to rest the head of the person receiving the massage. In one embodiment, the headrest 26 is selectively attached to the front of the first table top 22A.

The leg assembly 14 extends between the table top assembly 12 and the surface 20 to maintain the table top assembly 12 positioned above and away from the surface 20. In one embodiment, the leg assembly 14 includes a plurality of spaced apart legs. In FIG. 1, the leg assembly 14 includes a first leg 36A, a second leg 36B, a third leg 36C, and a fourth leg 36D that are pivotably secured to the table top assembly 12 and that are positioned at each corner of the table top assembly 12. Alternatively, the leg assembly 14 could be designed to have more than four or less than four legs and/or the legs 36A-36D can be secured to the table top assembly 12 in other locations than the perimeter of the massage table 10.

It should be noted that the terms first, second, third and fourth are used for convenience and that any of the legs can be designated as the first, second, third or fourth leg.

As provided herein, and as discussed in greater detail below, one or more of the legs 36A-36D can be designed so that the length of the legs 36A-36D can be adjusted to change the height of the massage table 10 in the working configuration.

In one embodiment, the massage table 10 includes (i) a rigid first leg cross brace 38A that is attached to and extends between the first leg 36A and the second leg 36B, and (ii) a rigid second leg cross brace 38B that is attached to and extends between the third leg 36C and the fourth leg 36D. The leg cross braces 38A, 38B provide additional support to the legs 36A-36D and facilitate movement of the legs 36A-36D between the positions. Non-exclusive examples of suitable materials for the leg cross braces 38A, 38B include wood, plastic, or aluminum. Alternatively, the massage table 10 can be designed without one or both leg cross braces 38A, 38B.

In FIG. 1, each cross brace 38A, 38B includes a brace transverse section 38C that extends transversely, and a pair of brace leg sections 38D that extends along a portion of the respective leg. In FIG. 1, the brace transverse section 38C is located near the top of the legs. Alternatively, each cross brace 38A, 38B can have another configuration or be in another location. For example, each cross brace 38A, 38B can have only the brace transverse section 38C that extends between the respective legs. In this design, the cross brace 38A, 38B can be positioned intermediate the top and bottom of the respective pair of legs.

The cable assembly 15 supports the leg assembly 14 and the brace assembly 16 when the massage table 10 is in the working configuration. The design of the cable assembly 15 can be varied. One embodiment of a suitable cable assembly 15 is disclosed U.S. Pat. No. 5,009,170, issued to Spehar, the contents of which are incorporated herein by reference.

The brace assembly 16 extends betweens the table top assembly 12 and leg assembly 14 to provide additional support to the leg assembly 14 when the massage table 10 is in the working configuration 18. Further, the brace assembly 16 allows the legs 36A-36D to be easily moved between the folded position (not shown), and the unfolded position illustrated in FIG. 1. In the embodiments illustrated in the Figures, the brace assembly 16 includes a first support assembly 39A that supports the first and second legs 36A, 36B, and a second support assembly 39B that supports the third and fourth legs 36C, 36D.

Figure 2:
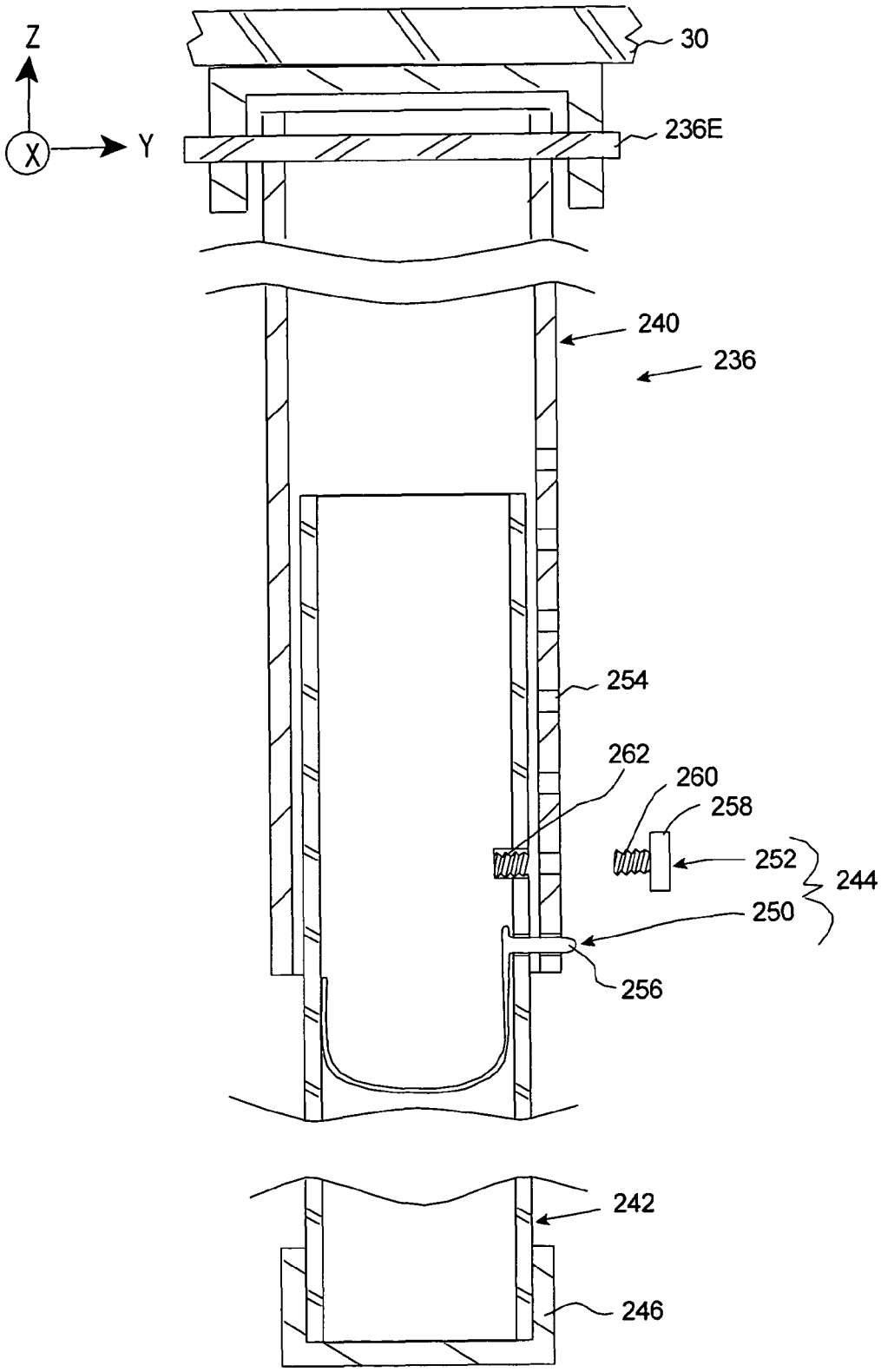
FIG. 2 is a simplified cut-away view of one embodiment of a leg.

FIG. 2 is a cross-sectional view of one embodiment of one leg 236 and a portion of the frame 30. It should be noted that one or all of the legs 36A-36D illustrated in FIG. 1 can have a design that is similar to the leg 236 illustrated in FIG. 2. FIG. 2 illustrates that the leg 236 is pivotably attached with a leg pivot 236E to the frame 30. With this design, the leg 236 can be moved between a folded and unfolded configuration.

In the embodiment illustrated in FIG. 2, the leg 236 is a telescoping type structure that includes an upper first leg section 240, a lower second leg section 242, and a section attacher 244 that selectively secures the leg sections 240, 242 together.

In this embodiment, each of the leg sections 240, 242 is substantially tubular shaped and a portion of the second leg section 242 fits and moves within the first leg section 240 in a telescoping type fashion. Further, in this embodiment, each of the leg sections 240, 242 has an annular shaped cross-section. Alternatively, for example, each of the leg sections 240, 242 can have an oval tube or square tube shaped cross-section. In alternative non-exclusive embodiments, each leg section 240, 242 has an outer diameter of approximately 0.5, 0.6, 0.7, 0.8, 0.9, 1, 1.1, 1.2, 1.3, 1.4, 1.5, or 2 inches. It should be noted that in the embodiment illustrated in FIG. 2, the diameter of the first leg section 240 is slightly greater than the diameter of the second leg section 242. Still alternatively, the first leg section 240 could be sized and shaped to fit within a portion of the second leg section 242. Non-exclusive examples of suitable materials for the leg sections 240, 242 include aluminum, steel, plastic or composite.

The bottom of the second leg section 242 can include a contact pad 246 that engages the surface 20 (illustrated in FIG. 1).

The section attacher 244 allows for controlled adjustment of the leg sections 240, 242 relative to each other and selectively inhibits relative movement of the leg sections 240, 242. In the embodiment illustrated in FIG. 2, the section attacher 244 includes a section stop 250 and a section clamp 252. In this embodiment, the section stop 250 selectively inhibits relative movement of the leg sections 240, 242 up and down along the Z axis and the section clamp 252 clamps the leg sections 240, 242 together to inhibit wiggling between the telescoping leg sections 240, 242. Stated another way, (i) the section stop 250 selectively inhibits large scale relative movement between the first leg section 240 and the second leg section 242 along a first axis, and (ii) the section clamp 252 selectively inhibits substantially all relative movement between the first leg section 240 and the second leg section 242. With this design, in certain embodiments, the section clamp 252 inhibits noise created by the wiggling of the leg sections 240, 242 during the massage. Further, with this design, the tolerances of the leg sections 240, 242 can be relaxed and the need for low friction contact surfaces between the leg sections 240, 242 is reduced.

In one embodiment, if only the section stop 250 is engaged, the leg sections 240, 242 can still move relative to each other approximately one eighth of an inch. This can cause a feeling of insecurity and lack of quality, as well as a significant amount of noise. Alternatively, if both the section stop 250 and the section clamp 252 are engaged, there is substantially no relative movement between the leg sections 240, 242. Further, in certain embodiments, if both the section stop 250 and the section clamp 252 are engaged, the leg sections 240, 242 functions somewhat like a single rigid structure.

In the embodiment illustrated in FIG. 2, the first leg section 240 includes a plurality of spaced apart section apertures 254 that are in line along the Z axis. In one embodiment, the section stop 250 includes a spring loaded detent button 256 that is secured to the second leg section 242. The spring detent button 256 is designed to fit through one of the section apertures 254 to provide a fixed stop position.

The section clamp 252, as illustrated in FIG. 2, can include a knob 258 and a threaded stud 260 that extends away from the knob 258. Further, the section clamp 252 can include an internally threaded surface 262 that is secured to the second leg section 242. In this design, the distance between the internally threaded surface 262 and the detent button 256 along the Z axis is approximately equal to the distance between adjacent section apertures 254 along the Z axis. With this design, the threaded stud 260 can be inserted into one of the section aperture 254 and threaded into the internally threaded surface 262 to draw the second leg section 242 against the first leg section 240.

In certain embodiments, the section clamp 252 feature allows for the use of larger clearances between the leg sections 240, 242. In alternative, non-exclusive embodiments, the clearances between the leg sections 240, 242 can be at least approximately 0.01, 0.02, 0.03, 0.04, 0.05, or 0.06 inches. This can reduce manufacturing costs and can improve ease of use because with larger clearances the legs sections 240, 242 slide easier relative to each other.

Figure 3:
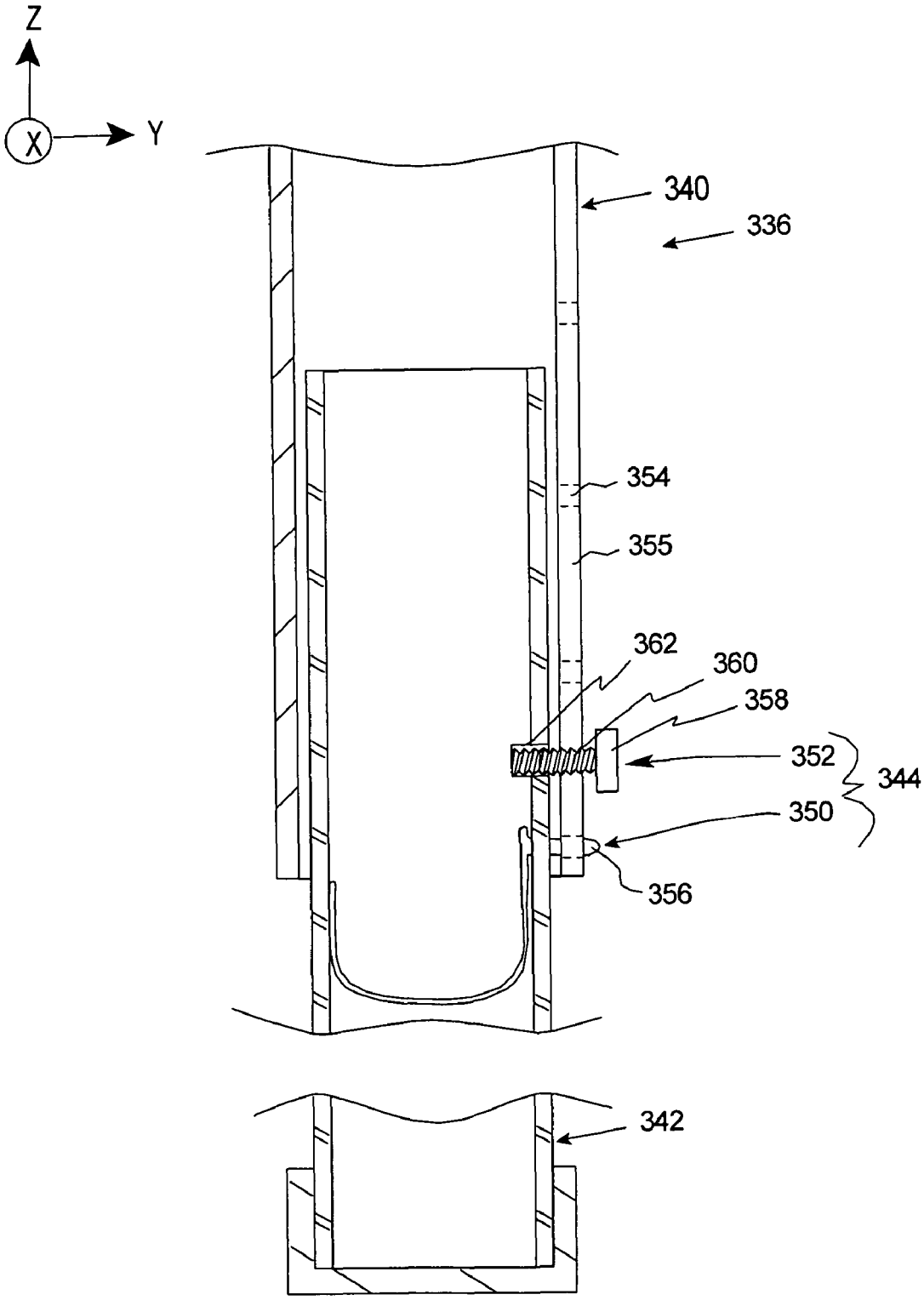
FIG. 3 is a simplified cut-away view of another embodiment of a leg.

It should be noted that many other designs of the secure, section attacher can be utilized. For example, FIG. 3 is a simplified cut-away view of another embodiment of a leg 336. One or all of the legs 36A-36D illustrated in FIG. 1 can have a design that is similar to the leg 336 illustrated in FIG. 3.

In this embodiment, the leg 336 includes an upper first leg section 340, and a lower second leg section 342 that are somewhat similar to the corresponding components. However, in FIG. 3, the section attacher 344 is slightly different. More specifically, in FIG. 3, the section stop 350 and a section clamp 352 are slightly radially offset from each other. Further, the first leg section 340 includes a plurality of spaced apart section apertures 354 (illustrated in phantom) that are in line along the Z axis and a section slot 355 that extends along the Z axis and that is offset from the section apertures 354. In this embodiment, the section stop 350 again includes a spring loaded detent button 356 that is secured to the second leg section 342. The spring detent button 356 is designed to fit through one of the section apertures 354 to provide a fixed stop position.

The section clamp 352, as illustrated in FIG. 3, can again include a knob 358 and a threaded stud 360 that extends away from the knob 358. Further, the section clamp 352 can include an internally threaded surface 362 that is secured to the second leg section 342. In this design, the threaded stud 360 fits into the section slot 355 and is threaded into the internally threaded surface 362. When the section clamp 352 is loose, first leg section 340 can be moved with the threaded stud 360 in the section slot 355. After the leg 336 is at the desired position, the detent button 356 fits into the section aperture 354 and the knob 358 can be rotated to draw the second leg section 342 against the first leg section 340.

Figure 4:
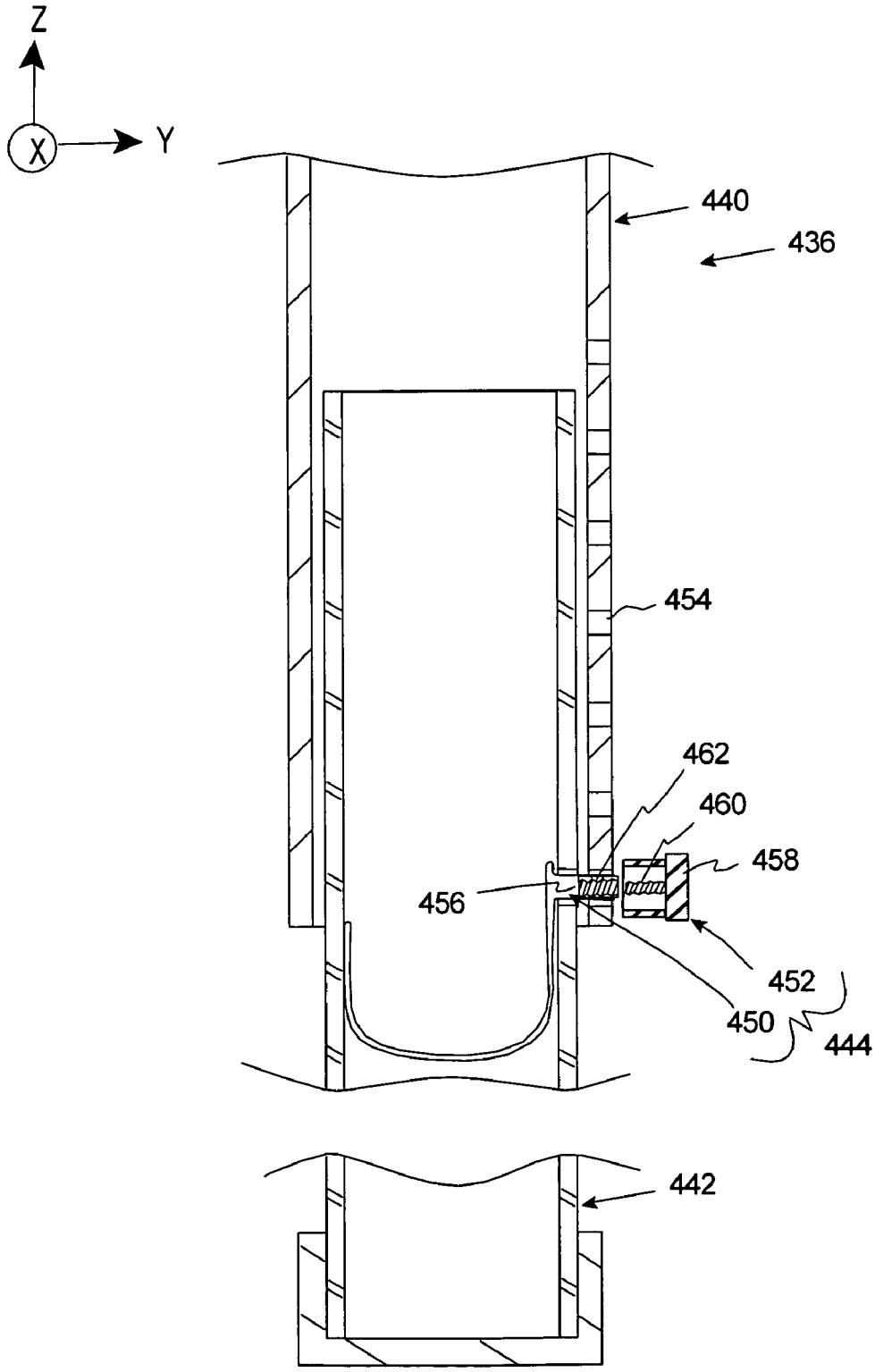
FIG. 4 is a simplified cut-away view of still another embodiment of a leg.

FIG. 4 is a simplified cut-away view of still another embodiment of a leg 436. One or all of the legs 36A-36D illustrated in FIG. 1 can have a design that is similar to the leg 436 illustrated in FIG. 4.

In this embodiment, the leg 436 includes an upper first leg section 440, and a lower second leg section 442 that are somewhat similar to the corresponding components. However, in FIG. 4, the section attacher 444 is slightly different. In FIG. 4, the first leg section 440 includes a plurality of spaced apart section apertures 454 that are in line along the Z axis. In this embodiment, the section stop 450 again includes a spring loaded detent button 456 that is secured to the second leg section 442. The spring detent button 456 is designed to fit through one of the section apertures 454 to provide a fixed stop position.

The section clamp 452, as illustrated in FIG. 4, can again include a knob 458 and a threaded stud 460 that extends away from the knob 358. Further, the section clamp 452 can include an internally threaded surface 462 that is secured to the detent button 456. In this design, after the detent button 456 is positioned in the desired section aperture 454, the threaded stud 460 can be threaded into the internally threaded surface 462 to draw the second leg section 442 against the first leg section 340.

Figure 5:
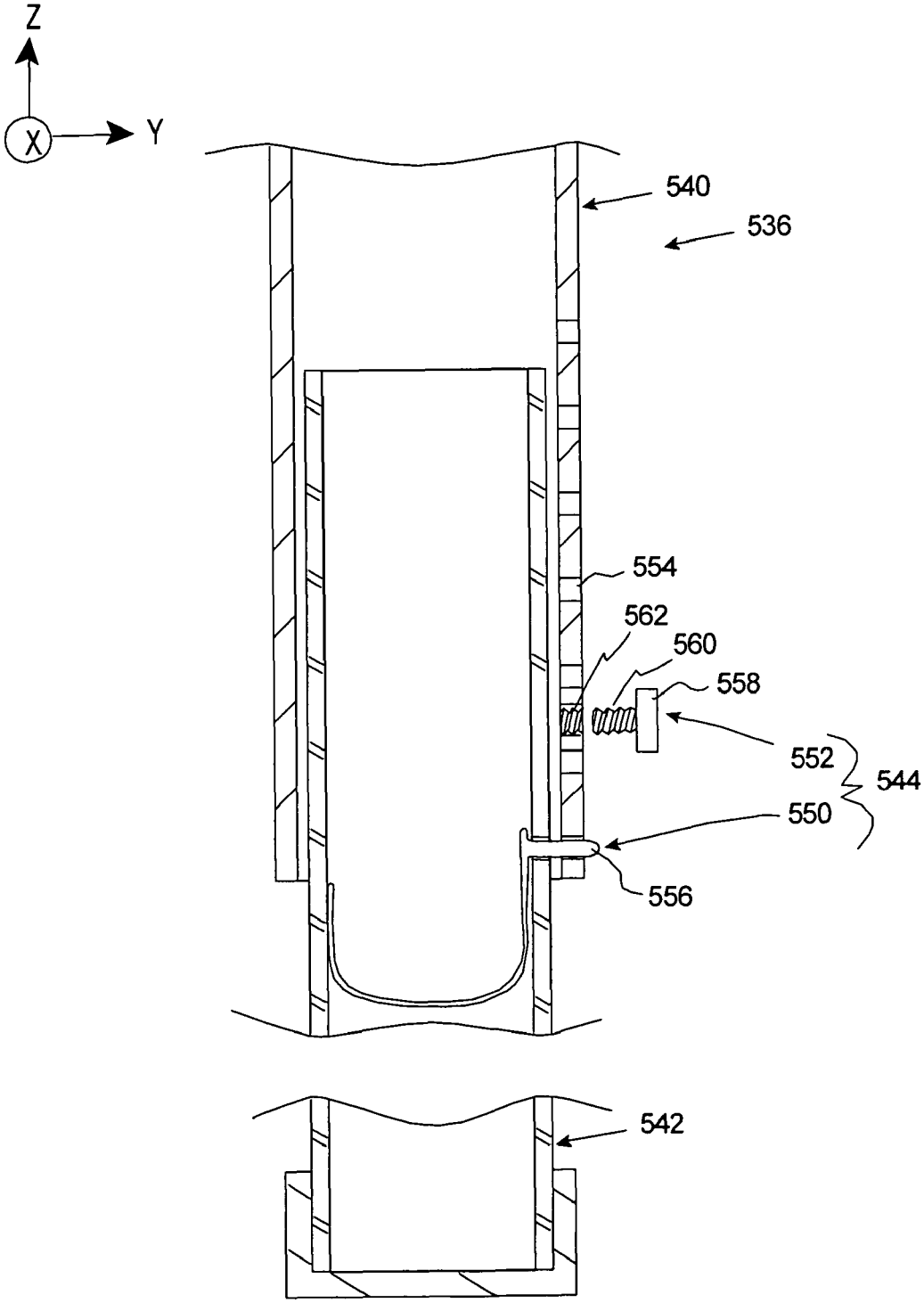
FIG. 5 is a simplified cut-away view of yet another embodiment of a leg.

FIG. 5 is a simplified cut-away view of yet another embodiment of a leg 536. One or all of the legs 36A-36D illustrated in FIG. 1 can have a design that is similar to the leg 536 illustrated in FIG. 5.

In this embodiment, the leg 536 includes an upper first leg section 540, and a lower second leg section 542 that are somewhat similar to the corresponding components. However, in FIG. 5, the section attacher 544 is slightly different. In FIG. 5, the first leg section 540 includes a plurality of spaced apart section apertures 554 that are in line along the Z axis. In this embodiment, the section stop 550 again includes a spring loaded detent button 556 that is secured to the second leg section 442. The spring detent button 556 is designed to fit through one of the section apertures 554 to provide a fixed stop position.

The section clamp 552, as illustrated in FIG. 5, can again include a knob 558 and a threaded stud 560 that extends away from the knob 558. Further, the section clamp 552 can include an internally threaded surface 562 that is secured to the first leg section 540. In this design, after the detent button 556 is positioned in the desired section aperture 554, the threaded stud 560 can be rotated and threaded into the internally threaded surface 562 to urge a portion of leg sections 540, 542 together.

In yet another alternative design, the section clamp can be another type of clamp that deforms one or both of the leg sections.

While the current invention is disclosed in detail herein, it is to be understood that it is merely illustrative of the presently preferred embodiments of the invention and that no limitations are intended to the details of construction or design herein shown other than as described in the appended claims.

What is claimed is:

1. A massage table for supporting a person above a surface during a massage, the massage table comprising:

a table top assembly including a first table top, a second table top, and a hinge assembly that pivotably connects the table top sections together; and a leg assembly that is secured to and supports the table top assembly above the surface, the leg assembly including four spaced apart legs, wherein each of the legs includes (i) a first leg section that is attached to the table top assembly, (ii) a second leg section that is movable relative to the first leg section to adjust the position of the table top assembly relative to the surface, and (iii) a section attacher that selectively attaches the first leg section to the second leg section, the section attacher including a section stop having a button that is secured to the second leg section, the button extending into an aperture in the first leg section to selectively inhibit relative movement between the first leg section and the second leg section, and the section attacher including a section clamp having a threaded stud that selectively threads into an internally threaded surface attached to one of the leg sections to selectively inhibit relative movement between the first leg section and the second leg section.

2. The massage table of claim 1 wherein at least a portion of the internally threaded surface extends into an opening in the second leg section.

3. A massage table for supporting a person above a surface during a massage, the massage table comprising:

a table top assembly; and a leg assembly that is secured to and supports the table top assembly above the surface, the leg assembly including a plurality of legs, wherein at least one of the legs includes (i) a first leg section that is attached to the table top assembly, the first leg section having three or more apertures that are substantially equally spaced apart along a first axis, (ii) a second leg section that is movable relative to the first leg section to adjust the position of the table top assembly relative to the surface, and (iii) a section attacher that selectively attaches the first leg section to the second leg section, the section attacher including a section stop having a button that is secured to the second leg section and that extends into one of the apertures in the first leg section to selectively inhibit relative movement between the first leg section and the second leg section, and the section attacher including a section clamp having an internally threaded surface that is secured to the second leg section and a threaded stud that extends through the first leg section and selectively threads into the internally threaded surface to selectively inhibit relative movement between the first leg section and the second leg section.

4. The massage table of claim 3 wherein the threaded stud is inserted through one of the three or more apertures to selectively inhibit relative movement between the first leg section and the second leg section, and wherein the distance between the internally threaded surface and the button along the first axis is approximately equal to the distance between any two of the three or more apertures.

5. The massage table of claim 3 wherein the leg assembly includes four spaced apart legs and each of the four legs includes (i) a first leg section that is attached to the table top assembly, the first leg section having three or more apertures that are substantially equally spaced apart along a first axis, (ii) a second leg section that is movable relative to the first leg section to adjust the position of the table top assembly relative to the surface, and (iii) a section attacher that selectively attaches the first leg section to the second leg section, the section attacher including a section stop having a button that is secured to the second leg section and that extends into one of the apertures in the first leg section to selectively inhibit relative movement between the first leg section and the second leg section, and the section attacher including a section clamp having an internally threaded surface that is secured to the second leg section and a threaded stud that extends through the first leg section and selectively threads into the internally threaded surface to selectively inhibit relative movement between the first leg section and the second leg section.

6. The massage table of claim 3 wherein a portion of the second leg section fits and moves within the first leg section.

7. The massage table of claim 3 wherein each of the legs is pivotably secured to the table top assembly.

8. The massage table of claim 3 wherein the table top assembly includes a first table top, a second table top, and a hinge assembly that pivotably secures the first table top to the second table top.

9. The massage table of claim 3 wherein at least a portion of the internally threaded surface extends into an opening in the second leg section.

10. A method for making an adjustable-height massage table, the method comprising the steps of:

providing a table top assembly;

supporting the table top assembly with a support assembly that is secured to the table top assembly, the support assembly including a leg assembly having a plurality of legs, wherein at least one of the legs includes (i) a first leg section having three or more apertures that are substantially equally spaced apart along a first axis, (ii) a second leg section, and (iii) a section attacher that selectively attaches the first leg section to the second leg section, the section attacher having a section stop and a section clamp;

selectively inhibiting relative movement between the first leg section and the second leg section along the first axis with the section stop, the section stop including a button that is secured to the second leg section and that extends into one of the apertures in the first leg section; and subsequently selectively inhibiting substantially all relative movement between the first leg section and the second leg section with the section clamp that urges at least a portion of the leg sections together.

11. The method of claim 10 wherein the section clamp includes an internally threaded surface that is secured to the second leg section, and wherein the distance between the internally threaded surface and the button along the first axis is approximately equal to the distance between any two of the three or more apertures.

12. The method of claim 10 wherein the step of selectively supporting includes a portion of the button being designed to fit through one of the three or more apertures.

13. The method of claim 10 wherein the step of subsequently selectively inhibiting includes the section clamp further having a threaded stud that fits through one of the three or more apertures and that threads into an internally threaded surface that is attached to the second leg section.

14. The method of claim 10 wherein the step of subsequently selectively inhibiting includes the section clamp further having a threaded stud that is designed to be threaded into an internally threaded surface.

15. The method of claim 10 wherein the step of supporting includes the leg assembly having four spaced apart legs, wherein each leg includes a first leg section, a second leg section, and a section attacher that selectively attaches the first leg section to the second leg section.

16. The method of claim 15 wherein the step of supporting includes each section attacher having a section stop and a section clamp.

17. The method of claim 10 wherein the step of supporting includes the step of pivotably securing each of the legs to the table top assembly.

18. A massage table for supporting a person above a surface during a massage, the massage table comprising:

a table top assembly including a first table top, a second table top, and a hinge assembly that pivotably connects the table top sections together; and a leg assembly that is secured to and supports the table top assembly above the surface, the leg assembly including four spaced apart legs, wherein each of the legs includes (i) a first leg section that is attached to the table top assembly, the first leg section including a plurality of spaced apart apertures, (ii) a second leg section that is movable relative to the first leg section to adjust the position of the table top assembly relative to the surface, and (iii) a section attacher including a section stop and a section clamp that each selectively attaches the first leg section to the second leg section, the section stop including a button that is secured to the second leg section, the button extending into one of the apertures in the first leg section to selectively inhibit relative movement between the first leg section and the second leg section, and the section clamp engaging at least one of the first leg section and the second leg section to selectively urge at least a portion of the leg sections together to selectively inhibit relative movement between the first leg section and the second leg section.

* * * * *